US005634424A

United States Patent [19]

Ortelli

[11] Patent Number: 5,634,424

[45] Date of Patent: Jun. 3, 1997

[54] MODULAR STRUCTURE FOR SUPPORTING AND GUIDING SLIDING TUBES IN PARTICULAR FOR SUBMARINE TOWERS

[75] Inventor: Aurelio Ortelli, Bologna, Italy

[73] Assignee: Riva Calzoni S.P.A., Bologna, Italy

[21] Appl. No.: 550,842

[22] Filed: Oct. 31, 1995

[30] Foreign Application Priority Data

Nov. 9, 1994 [IT] Italy ..... MI94A2267

[51] Int. Cl.[6] ..... B63E 8/04

[52] U.S. Cl. ..... 114/339; 114/340

[58] Field of Search ..... 114/339, 340, 114/312, 65 R, 341, 342, 79 R

[56] References Cited

U.S. PATENT DOCUMENTS 1,831,479 11/1931 Bryant ..... 114/79 R 2,103,715 12/1937 Frear ..... 114/79 R 3,171,281 3/1965 Coyle et al. ..... 114/312

FOREIGN PATENT DOCUMENTS

C-240 898 12/1908 Germany .

J04137 8/1909 United Kingdom .

2 220 390 1/1990 United Kingdom ..... 114/340

*Primary Examiner*—Sherman Basinger

*Attorney, Agent, or Firm*—Herbert Dubno

[57] ABSTRACT

A modular structure for supporting and guiding tubes slidable in the vertical direction and carrying sensing, reconnaissance and transmission equipment for submarine towers, a frame formed by uprights and walls, which are longitudinal and transverse defining vertical compartments inside which the tubes supporting the equipment are slidable. The frame is secured to only the hull of the submarine via horizontal base elements which are integral with the bottom ends of the uprights and can be secured to corresponding flanges fixed to the hull of the submarine.

6 Claims, 2 Drawing Sheets

3
5
4
12
9
12a
12
12
a)
12a
2a
2c
2a
2b
2
b)
2c
2b
2b
2c
2
c)

3
5
6
7
8
3
50
3
4
9
a)
3
6
107
108
4
3
5
500
3
9
b)
4
5
1007
1008
6
3
9
5000
3
c)

MODULAR STRUCTURE FOR SUPPORTING AND GUIDING SLIDING TUBES IN PARTICULAR FOR SUBMARINE TOWERS

FIELD OF THE INVENTION

The present invention relates to a modular structure for supporting and guiding tubes slidable in the vertical direction and carrying sensing, reconnaissance and transmission equipment for submarine towers.

BACKGROUND OF THE INVENTION

In submarines it is necessary to install inside the tower, also referred to as the "sail", projecting from the top of the hull, devices for raising sensing, monitoring and transmission equipment and the like, which must be brought from a non-operating position, inside the tower itself, into a working position, outside the tower, so as to allow, for example, a sensor to be brought outside the surface of the water, while keeping the submarine submerged so as to avoid being seen.

Raising and lowering devices designed to perform this movement are also known, said devices being fixed, independently of one another, both to the hull of the submarine and to the strong part of the tower structure so as to transmit to the structure itself both the axial forces to and the transverse forces which the raising devices are subject when they are raised, on account of their hydrodynamic resistance.

It is also known that these solutions which represent the state of the art require difficult installation and setting-up operations on board the submarine for correct alignment of the movable raising elements.

OBJECT OF THE INVENTION

The object of the invention is to provide a structure designed to support and guide tubes for raising sensing and transmission equipment and the like inside the tower of submarines, which can be easily and rapidly installed on board the submarine itself, which allows all the assembly operations and checks for alignment of the parts to be carried out at the construction and/or assembly site and prior to installation thereof on the submarine and which allows, moreover, a reduction in the overall external dimensions of the tower, and the need for fixing thereto with a consequent reduction in the structural complexity of the tower, as well as the overall weight of the tower itself and the raising devices.

SUMMARY OF THE INVENTION

These results are obtained by the present invention, which provides a modular structure supporting and guiding tubes slidable in the vertical direction and carrying sensing, reconnaissance and transmission equipment for submarine towers. The modular unit comprises a frame formed by uprights and walls, which are longitudinal and transverse, defining vertical compartments inside which the tubes supporting said equipment are slidable on guides, said frame being secured to only the hull of the submarine via horizontal base elements which are integral with the bottom ends of the uprights and can be secured to corresponding flanges fixed to the hull of the submarine.

More particularly, the uprights have different cross-sections so as to allow modular expansion of the frame and internal surfaces which are machined to form sliding and guiding means designed to be coupled with corresponding runners fixed to the tubes via associated horizontal brackets.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
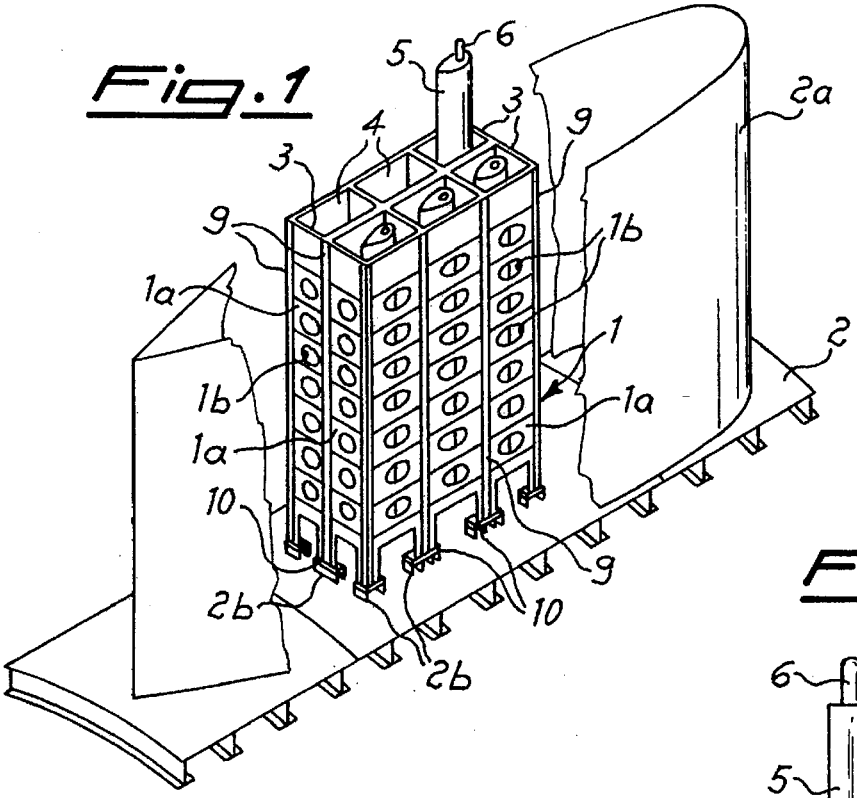
FIG. 1 is a diagrammatic perspective view of the structure according to the invention.

As shown in the Figures, the structure according to the invention is composed essentially of a frame 1, the vertical walls 1*a* of which have a height equal to the height of the tower 2*a* fixed to the upper surface of the hull 2 of a submarine; the vertical walls can have formed in them apertures 1*b*, as for example illustrated in the figures, which reduce the weight The frame 1 consists of longitudinal and transverse vertical walls 3, fixed to uprights 9 of the frame itself, so as to form vertical compartments 4 having arranged inside them tubes 5 or the like carrying at the top devices 6 to be raised and lowered; the vertical compartments 4 also have arranged inside them the associated devices for operating the tubes 5 which, being known per se, are not illustrated and described in detail.

The bottom ends of the frame 1, in correspondence with the uprights 9 thereof, are provided with base elements 10 (FIGS. 1 and 2) designed to be secured to corresponding flanges 2*b* fixed to the upper surface of the hull 2 of the submarine via bolts or screws.

Figure 2:
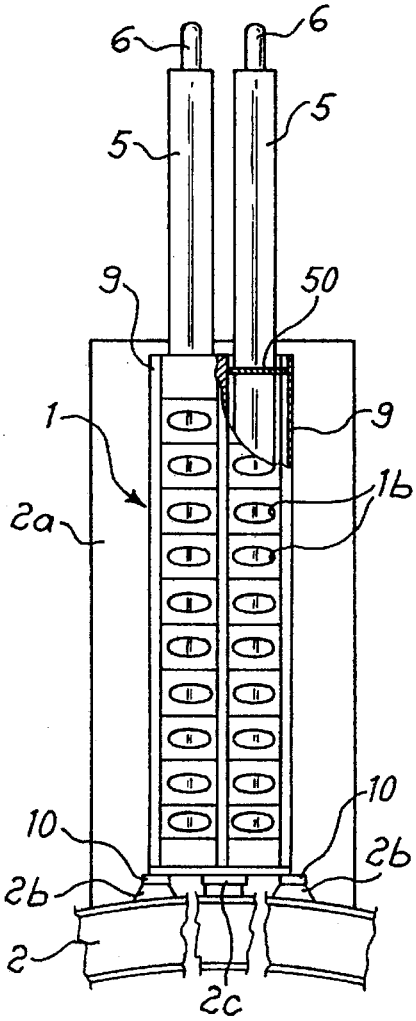
FIG. 2 is a front view of the structure according to FIG. 1.
Figure 3:
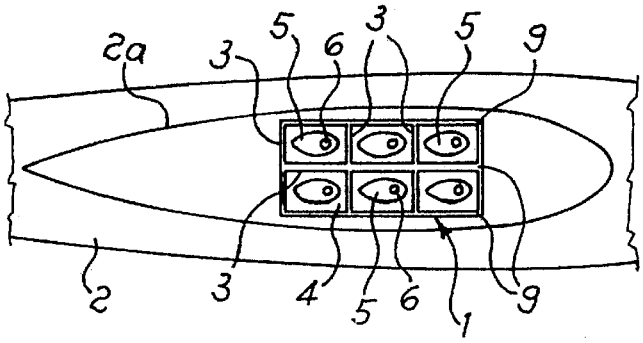
FIG. 3 is a plan view of the structure according to FIG. 1.
Figure 4:
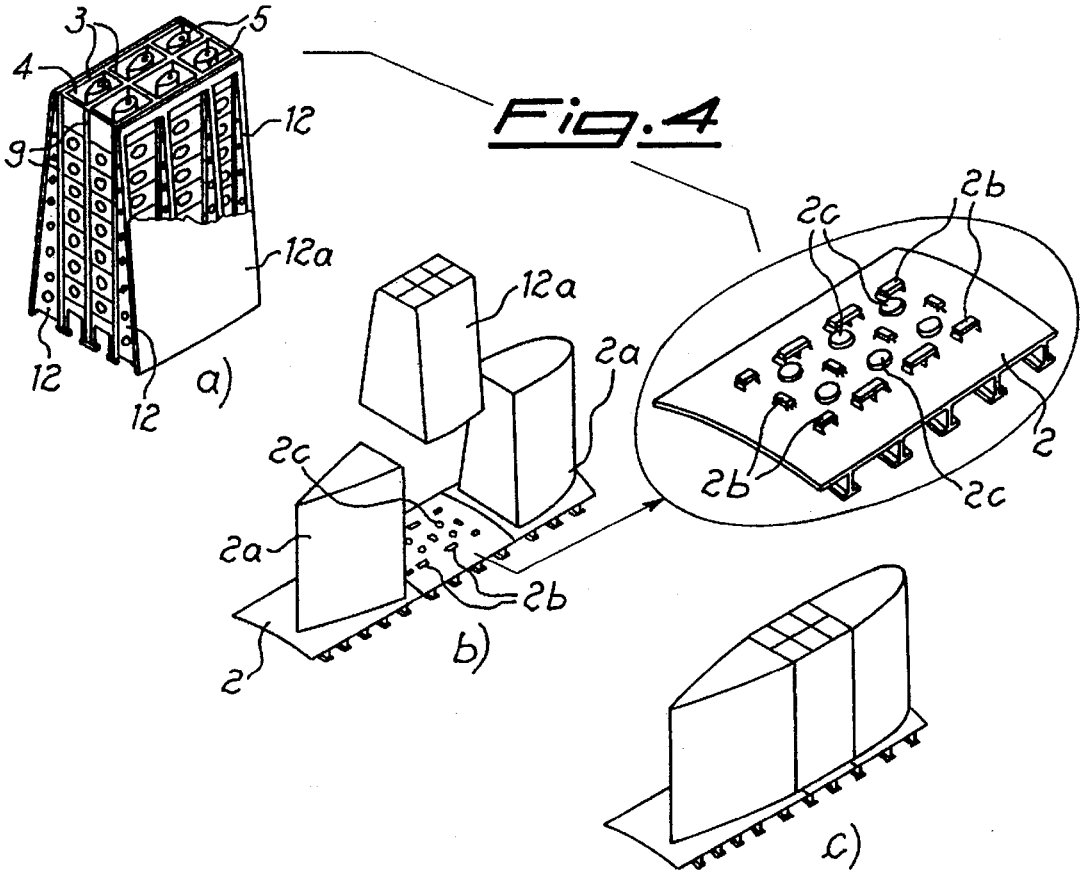
FIGS. 4*a*, 4*b* and 4*c* are diagrammatic views illustrating assembly of the tower part corresponding to the structure according to the invention.

As illustrated in FIGS. 2 and 4*b*, the hull 2 of the submarine has additional flanges 2*c* to which the devices actuating the movement of the tubes 5 inside the frame 1 are fixed. The flanges 2*c* are therefore located in the area inside the perimetral support flanges 2*b* of the frame 1.

Figure 5:
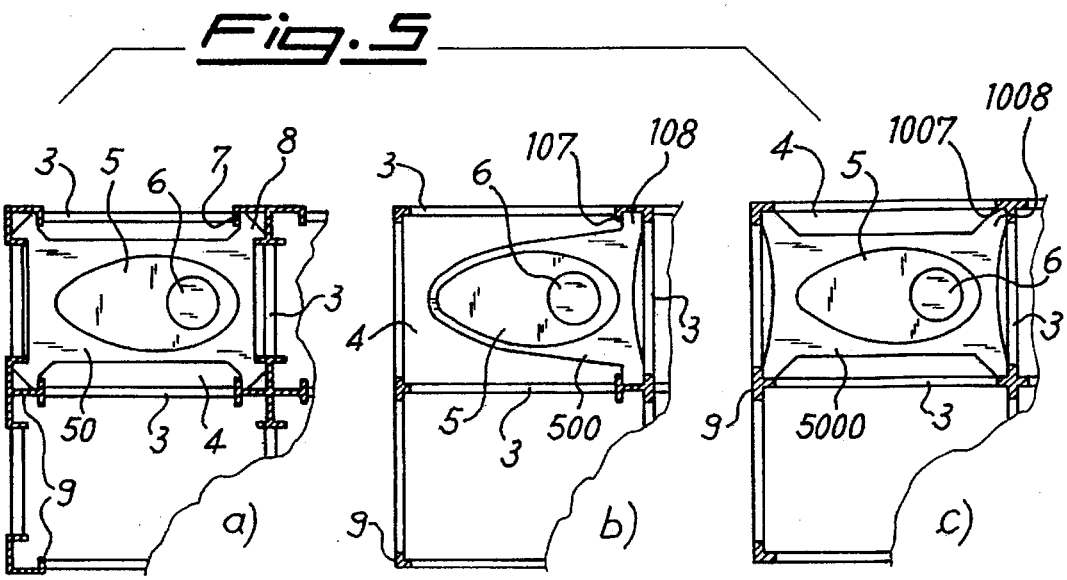
FIGS. 5*a*, 5*b* and 5*c* are diagrammatic horizontal sections through the structure according to the invention, illustrating different types of embodiment of the associated sliding means.

As shown in FIG. 5*a*–5*c*, the uprights 9 of the frame 1 can be realized in accordance with different possible alternative configurations, illustrated in FIGS. 5*a*, 5*b* and 5*c*, respectively, in order to form structural elements for joining the vertical walls 3 so as to allow the construction of the internal vertical compartments 4 in a modular manner and on the basis of the overall number of tubes 5 to be installed. Said uprights have, moreover, internal surfaces 7,107,1007 for the sliding and guiding of corresponding runners 8,108, 1008 made of suitable anti-friction material arranged at the corners of horizontal brackets 50,500,5000 fixed at different points along the height of the tube 5 so as to ensure that it is aligned with respect to the fixed guides 7,107,1007 and remains coaxial during raising and lowering.

It is therefore obvious how, with the modular structure according to the invention, it is possible to obtain, through grouping the elements which before were spread out in the tower, a reduction in the spaces required for the raising movements inside the tower itself, with a consequent reduction in both the transverse and longitudinal dimensions of the assembly, this allowing a reduction in the corresponding dimensions of the tower or sail with consequent advantages from the point of view of the hydrodynamics.

In addition, it is possible to obtain a reduction in the weight of the entire assembly, compared to the known art, since a large part of the walls and the corners of the guide structure are common to the various modules.

A further advantage of the invention compared to the known art consists in the fact that the fixed guide structure has an intrinsic structural strength such as to no longer require any securing of its top part to the structure of the tower, but even be able to withstand itself the stresses of a hydrodynamic type which are transmitted onto the tower, particularly in the transverse direction.

This means that, in the zone occupied by the frame according to the invention, a tower structure of any kind is no longer required and the side cover panels 12*a* of the tower can be applied directly to the frame 1 by means of simple lightweight connecting elements 12 carrying the said panels 12*a* (FIG. 4*a*).

All of this represents a further reduction in weight for the submarine, which is all more important when one considers the high position of this structure in relation to the stability of the boat.

In addition to this and owing to the fact that all the fixing is performed by means of a series of flanges 2*b*, 2*c* fixed to the resistant hull of the submarine, opposite the base of the frame, all being located on the same plane (FIGS. 1 and 4*a*) and no other connecting joint being required, it can be seen how easily and quickly the joining means can be provided on the submarine and how the entire prefabricated structure can be very simply and rapidly assembled as one piece on the hull of the submarine (FIGS. 4*a* and 4*b*).

This also means that it is possible to assemble and test the entire set of raising devices in the workshop, thus facilitating and speeding up said operations and simplifying programming of the setting-up operations on the hull of the boat; obviously the assembled unit can already be completed in the workshop together with the external panels so that the tower section in this zone is already fully complete.

Consequently there is also an overall reduction in the total costs both owing to the fact that a large part of the tower structure no longer has to be constructed and owing to the speed of the operations involving assembly and preparation of the set of raising devices on board the submarine.

Many variations may be made as regards realization of the parts which make up the invention, without thereby departing from the protective scope of the present patent as defined by the claims which follow.

I claim:

1. A modular structure for sending, reconnaissance and transmission equipment for a submarine tower of a submarine having a hull comprising:

a frame formed by uprights and walls, which are longitudinal and transverse, defining a plurality of vertical compartments;

respective tubes supporting said equipment and received in each of said compartments and vertically slidable on guides therein; and horizontal base elements integral with bottom ends of the uprights and secured to corresponding flanges fixed to the hull of the submarine whereby said frame is secured only to said hull of the submarine.

2. A modular structure for sending, reconnaissance and transmission equipment for a submarine tower of a submarine having a hull comprising:

a frame formed by uprights and walls, which are longitudinal and transverse, defining a plurality of vertical compartments;

respective tubes supporting said equipment and received in each of said compartments and vertically slidable on guides therein; and horizontal base elements integral with bottom ends of the uprights and secured to corresponding flanges fixed to the hull of the submarine whereby said frame is secured only to said hull of the submarine said uprights having different cross-sections so as to allow modular expansion of the frame and internal surfaces which are machined to form sliding and guide means designed to be coupled with corresponding runners fixed to the tubes via horizontal brackets.

3. The modular structure according to claim 2, wherein said runners fixed to the tubes are guided on four corner uprights of each vertical compartment.

4. The modular structure according to claim 2, wherein said runners are guided by two adjacent corner uprights of each vertical compartment.

5. The modular structure according to claim 1, wherein said frame is covered by panels forming the external surface of the tower and fixed to the frame by means of connecting elements.

6. The modular structure according to claim 1 wherein said flanges fixed to the hull of the submarine are coplanar.

* * * * *